United States Patent [19]

Dixon et al.

[11] Patent Number: 5,007,847

[45] Date of Patent: Apr. 16, 1991

[54] UNIVERSAL GROUND ADAPTER ASSEMBLY

[75] Inventors: David S. Dixon, Old Lyme; Nicholas Schade, Oakdale, both of Conn.

[73] Assignee: The United States of America as represented by the Secretary of the Navy, Washington, D.C.

[21] Appl. No.: 539,954

[22] Filed: Jun. 18, 1990

[51] Int. Cl.[5] ..... H01R 4/66

[52] U.S. Cl. ..... 439/100; 174/65 SS; 439/98

[58] Field of Search ..... 439/98, 100; 174/65 SS, 174/84 S

[56] References Cited

U.S. PATENT DOCUMENTS

| | | | |
|---|---|---|---|
| 4,608,454 | 8/1986 | Lackinger | 174/65 SS |
| 4,692,563 | 9/1987 | Lackinger | 174/65 SS |
| 4,857,015 | 8/1989 | Michaels | 439/98 X |

FOREIGN PATENT DOCUMENTS

| | | | |
|---|---|---|---|
| 2074395 | 10/1981 | United Kingdom | 174/65 SS |

*Primary Examiner*—Eugene F. Desmond

*Attorney, Agent, or Firm*—Michael J. McGowan; Prithvi C. Lall

[57] ABSTRACT

An electromagnetically shielded connector assembly that enables connection from any one of conduit and cable to any one of conduit, cable and ground plane irrespective of the particular sizes of the members to be connected.

10 Claims, 2 Drawing Sheets

UNIVERSAL GROUND ADAPTER ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to electrical grounding equipment, and more particularly, to a shield ground adapter ("SGA" hereinafter) and to a conduit ground adapter ("CGA" hereinafter) designed to shunt high level electromagnetic ("EM" hereafter) energy from cable shields or conduits to a metallic boundary or ground plane such as a kickpipe/stuffing tube ("KP/ST" hereinafter) assembly, through which the cable passes. The EM energy can be caused by lightning, or by such high level EM sources as an electromagnetic pulse ("EMP" hereinafter). This shunting of EM energy from the cable shield or conduit to the metallic boundary, through which the cable passes, prevents the high level currents, voltages and EM fields induced thereby, from penetrating into the space protected by the metallic boundary or ground plane, through which the cable passes.

(2) Description of the Prior Art

Prior to the present invention all ground adapters, SGA's and CGA's utilized either soldered, compression or spring type devices to electrically connect the shield or conduit to a mechanical adapter assembly. Such assemblies were then threaded into KP/ST assemblies to provide mechanical connection to the ground plane or metallic boundary. The electrical connection to the ground plane or metallic boundary was provided by either mechanical threads, or by a spring type device, which typically required that the cable, conduit or KP/ST assembly meet stringent dimensional tolerances. Electrical connection to the KP/ST assemblies were typically made using the inside threads of the KP/ST. These thread interfaces have been shown to degrade over time and environmental conditions until the EMI-/EMP ground is completely lost. With all of these heretofore known devices, the size of the ground adapter that was used was dependent on both the cable or conduit size and on the KP/ST size, which required a stock of separate ground adapters for every different cable/-conduit and ST/KP assembly size combination. If, for example, ten different sizes of cable or conduit and five different sizes of KP/ST assemblies were required, an inventory of as many as fifty differently sized ground adapters had to have been stocked. Furthermore, cable conduits and KP/ST assemblies that were to be nominally of the same size but were manufactured by different companies have nonetheless had different dimensions. In order to accommodate such dimensional differences, a stock of a set of ground adapters for each manufacturer had to have been maintained. These heretofore known ground adapter devices suffered from the further limitation that no ground adapter was completely cross-compatible, as, for example, an adapter designed for grounding shields was not compatible for use with a conduit, and vice versa.

SUMMARY OF THE INVENTION

In accordance with one object of the present invention, a universal ground adapter (UGA) is provided that is universally compatible with all varieties of cable, conduit and KP/ST assemblies. The UGA is not dependent on the inner threads of the KP/ST assembly to achieve its low impedance, high frequency, high current capable ground.

In accordance with a further object of the present invention, such a ground adapter is provided that enables a wideband, 360 degree, low-impedence connection to exist between any selected member to be shielded and a mechanical shielding device.

In accord therewith, a cable shield-to-conduit connection, a cable shield-to-KP/ST assembly connection, a conduit-to-conduit connection, and a conduit-to-KP/ST assembly connection are provided.

BRIEF DESCRIPTION OF THE DRAWINGS

Other objects, features and advantages of the present invention will become apparent upon reference to the following description of the preferred embodiments, and to the drawings, wherein.

DESCRIPTION OF THE PREFERRED EMBODIMENTS

Figure 1:
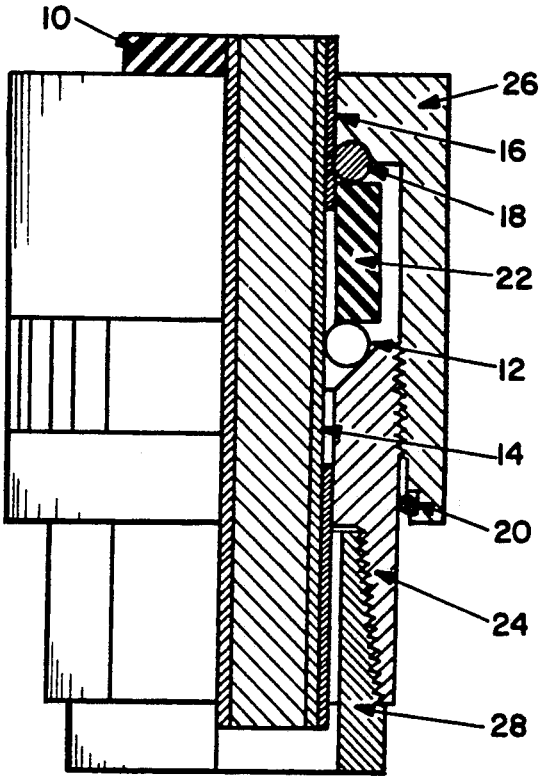
FIG. 1 is partially sectional, partially pictorial view of a female ground adapter of a universal ground adapter in accordance with the present invention.

Referring now to FIG. 1, there is shown a female ground adapter of the universal ground adapter in accordance with the present invention. Electrical contact with the cable 10 is typically made with a stainless steel or bronze iris or other conductive annular spring 12, contacting the cable shield 14 via a slot cut in the cable jacket 16. An environmental seal is maintained by annular, preferably rubber, O-ring seals 18 and 20. The constricting pressure of the iris spring 12 on the cable shield 14 is maintained via downward pressure from the pressure ring 22 on the iris spring 12 which is forced inward via the slope of the top of the adapter nut 24. Downward pressure on the pressure ring 22 is applied via the O-ring seal 18 which is, in turn, compressed via the aluminum, stainless steel, bronze or other conductive or non-conductive outer nut 26. The iris spring 12 preferably is a 360°, helically wound element that, as compressed, substantially contacts itself with substantially no gaps between turns in order to accomodate the EMP frequencies and wavelengths typically encountered. The outer nut 26 is threaded onto the aluminum, stainless steel, or bronze or other conductive adapter nut 24. Electrical contact to ground or to a metallic barrier is provided by threading the female pipe-threaded adapter nut 24 onto a male pipe-threaded metallic pipe 28. Conduit of course may be substituted for the cable as appears more fully herein.

Figure 2:
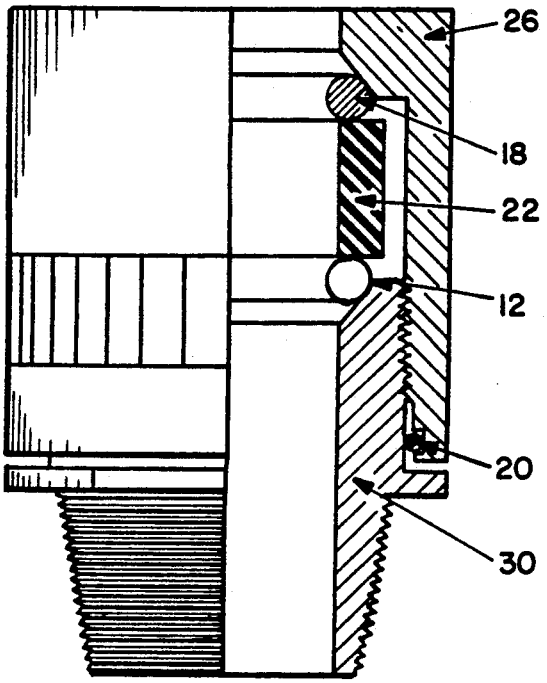
FIG. 2 is a partially sectional, partially pictorial view of a male ground adapter of a universal ground adapter in accordance with the present invention.

The device of FIG. 2 is the same as that of FIG. 1, and similar components in FIG. 2 carry the same notation and operate similarly to those shown and described with reference to FIG. 1. The adapter nut 30 differs from the adapter nut 24 of FIG. 1 in that it has a male pipe-thread as opposed to the female. The thread size is however the same for adapter nut 30 of FIG. 2 as that of the adapter nut 24 of FIG. 1.

Figure 3:
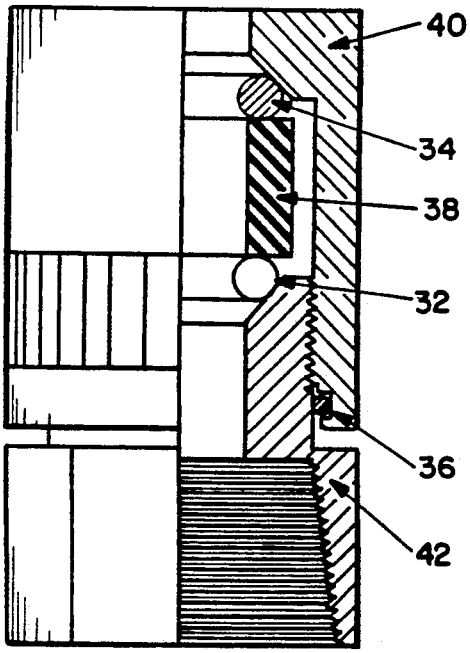
FIG. 3 is a partially sectional, partially pictorial view of the female ground adapter of the universal ground adapter configured for a comparatively smaller cable, conduit or KP/ST assembly in accordance with the present invention.

The device of FIG. 3 is the same as those of FIG. 1 and FIG. 2, and the parts 32, 34, 36, 38, and 40 of FIG. 3 are similar in operation to the parts 12, 18, 20, 22 and 26 respectively of FIG. 1. The diameter of the cable which they are adapted to is different, and, particularly, FIG. 3 shows an adapter to fit a cable or conduit which is of a smaller diameter than the diameter for which the devices of FIG. 1 and FIG. 2 fit. Adapter nut 42 of FIG. 3 and adapter nut 24 of FIG. 1 have the same size of pipe-thread. The difference between adapter nut 42 of FIG. 3 and the adapter nut 24 of FIG. 1 is that the adapter nut 42 is sized, on the top thereof, to fit the different diameter of the parts 32, 34, 36, 38, and 40.

Figure 4:
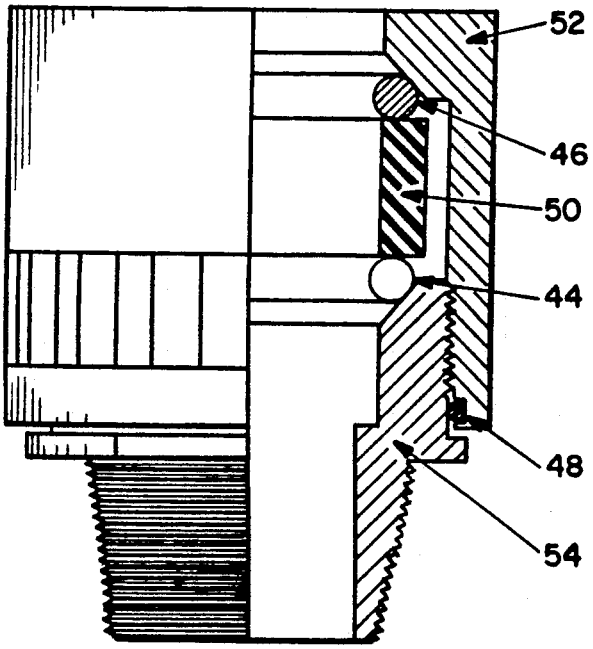
FIG. 4 is a partially sectional, partially pictorial view of the male ground adapter of the universal ground adapter configured for a comparatively larger cable, conduit or KP/ST assembly in accordance with the present invention.

Similarly, the device of FIG. 4 is the same as the devices of FIG. 3 as well as of FIG. 1 and of FIG. 2, and the parts 44, 46, 48, 50, and 52 thereof are similar in operation to the parts 32, 34, 36, 38, and 40, respectively, of FIG. 3. FIG. 4 shows the parts 44, 46, 48, 50, and 52 adapted to fit a larger diameter cable or conduit. Again, the adapter nut 54 has the same male thread sizes as the part 30 of FIG. 2, the difference therebetween being the larger diameter of the top thereof to fit the parts 44, 46, 48, 50, and 52. The device of FIG. 4 may be adapted to smaller diameter cables or conduit in a similar manner as the device of FIG. 3, and conversely, the device of FIG. 3 may be adapted to accommodate larger diameter cable or conduit in manner similar to that of the device of FIG. 4.

Figure 5:
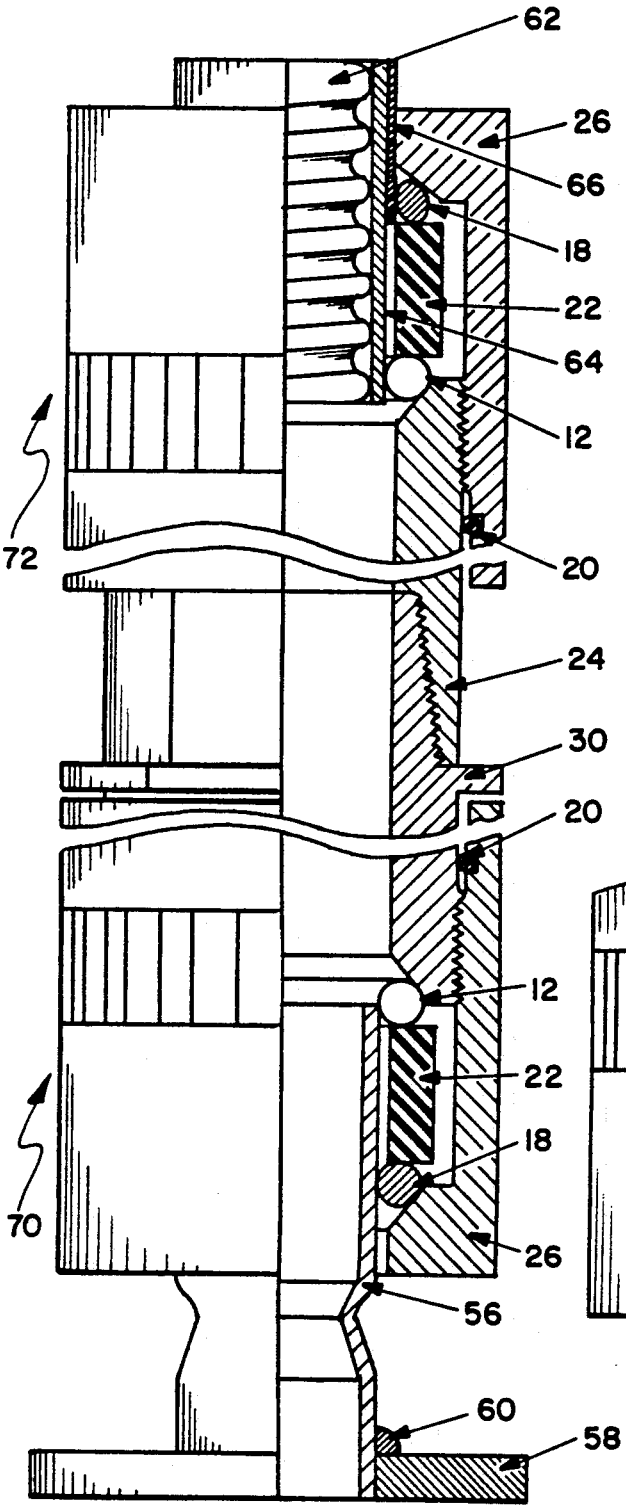
FIG. 5 is a partially sectional, partially pictorial view of the universal ground adapter of the present invention in an exemplary embodiment connecting conduit to a KP/ST assembly.

Referring now to FIG. 5, the operation of the device of FIG. 5 is the same as those of FIG. 1 and FIG. 2, and similar components in FIG. 5 carry the same notation and operate in the same manner as those shown and described with reference to FIG. 1 or FIG. 2. The difference is that the female adapter nut 24 is threaded into the male adapter nut 30. Adapter member illustrated generally by arrow 70 of FIG. 5 is shown connecting to an aluminum, steel or other conductive KP/ST assembly 56. The iris spring 12 now provides electrical contact to the outside wall of the KP/ST assembly 56 and the O-ring 1 provides the environmental seal with the KP/ST assembly 56. The KP/ST assembly 56 is connected to the metallic boundary 58 via the weld 60. Adapter member illustrated generally by arrow 72 of FIG. 5 is shown connecting at the other end to a conduit 62 where the iris spring 12 provides electrical contact to the braid 64 of the conduit 62. The O-ring 18 supplies the environmental seal with the conduit jacket 66. Continuous electrical contact from the conduit 62 to the metallic boundary 58 is thus provided via the conduit braid 64 to the top iris spring 12 to the adapter nut 24 to the adapter nut 30 to the bottom iris spring 12 to the KP/ST assembly 56 and the weld 60. Full, wideband, 360 degree low-impedence connection between the braid 64 and metallic boundary 58 is thereby provided in the exemplary FIG. 5 embodiment. Other exemplary connections are possible without departing from the inventive concept.

Figure 6:
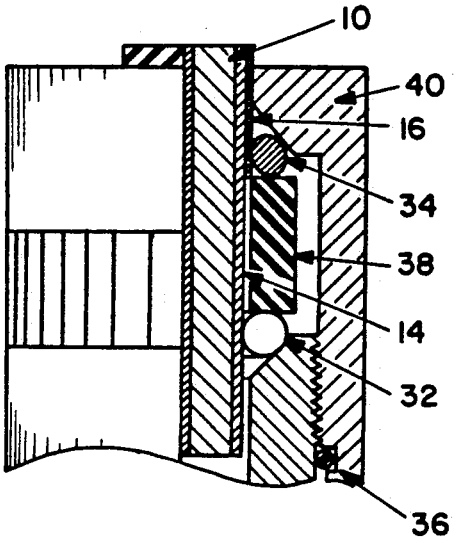
FIG. 6 and FIG. 7 are partially sectional, partially pictorial views of alternative embodiments of the ground adapter of the present invention, respectively connecting to shield and conduit.

For one example, FIG. 6 shows the device of FIG. 3 connecting to cable. Substituting the adapter member of FIG. 6 for the adapter member 72 of FIG. 5 provides continuous electrical contact from the cable shield to the metallic boundary in the same manner as that described above for the conduit member of FIG. 5.

Figure 7:
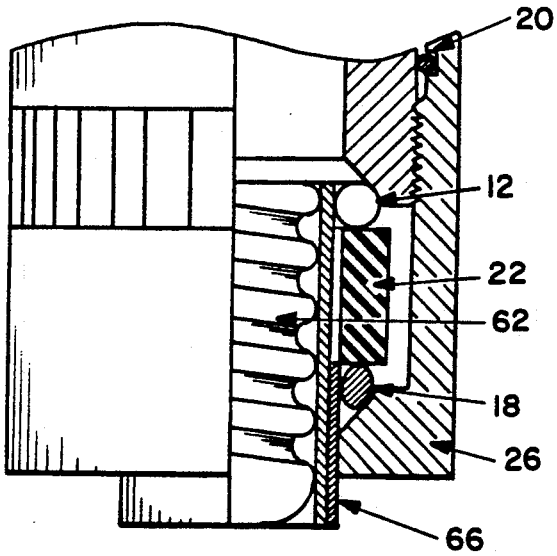

For another example, FIG. 7 shows the same device as adapter member 72 of FIG. 5. Substituting the adapter member of FIG. 7 for the adapter member 70 of FIG. 5 provides continuous electrical contact from the conduit 62 of section member 72 (FIG. 5) to the conduit 62 of FIG. 7.

Any size of cable or conduit may in this manner be connected to any other size KP/ST assembly, cable or conduit. The pipe thread interface between adapter nuts 24 and 30 (FIG. 5) provides both the necessary environmental seal and 360 degree mechanical connection as well as avoids electrical contact problems associated with standard straight threads.

The above described universal ground adapter thereby provides an EM interference and EMP grounding of any one of conduit, cable and KP/ST assembly independently of size of any two joined members and in such a way as to maintain environmental integrity and electrical connection.

Many modifications of the presently disclosed invention will become apparent to those skilled in the art without departing from the scope of the instant invention.

What is claimed is:

1. A universal ground adapter assembly, electrically and mechanically connecting first and second members defining interior spaces of selected same and different particular outside dimensions selected over a range of comparatively greater and lesser outside dimensions, and shielding the interior spaces of the first and second members against electromagnetic interference, comprising:

first and second subassemblies each having opposing ends, one end of one of the first and second subassemblies having an electrically conductive connection annulus itself having ends, the connection annulus terminates on one of its ends in an outer threaded wall defining an electrically conductive male connector and terminates on the other of its ends in an outer threaded wall of a preselected outer dimension, one end of the other one of the first and second subassemblies having an electrically conductive connection annulus itself having ends, the connection annulus of the other one of the first and second subassemblies terminates on one of its ends in an inner threaded wall defining an electrically conductive female connector and terminates on the other of its ends in an outer threaded wall having a preselected outer dimension, said male and said female connectors each having a preselected predetermined dimension reciprocally selected to allow male/female interconnection therebetween, each of the other ends of the first and second subassemblies having an electrically conductive member receiving annulus itself having ends, one end of each of the electrically conductive member receiving annuli having an inner preselected dimension selected to closely fit around the particular outside dimension of a respective one of said first and second members and the other end of each of the electrically conductive member receiving annuli terminating in an inner threaded wall having a preselected inside dimension, the preselected inside dimensions of said threaded walls of said ends of said member receiving annuli and said preselected outside dimensions of said ends of said connection annuli being selected to allow their mutual threaded interconnection, the preselected outside dimensions of said ends of said connection annuli being selected in direct proportion to the particular outside dimensions of corresponding ones of said first and second members being connected within said range;

means cooperative with said connection and member receiving annuli of each of said first and second subassemblies for electrically contacting respective ones of said first and second members; and means cooperative with said electrical contacting means and said connection and member receiving annuli of each of said first and second subassemblies for environmentally sealing said electrically contacting means.

2. The universal ground adapter assembly of claim 1, wherein one of said first and second members is a shield, and the other of said first and second members is a conduit.

3. The universal ground adapter assembly of claim 1, wherein one of said first and second members is a shield, and the other of said first and second members is a kickpipe/stuffing tube assembly.

4. The universal ground adapter assembly of claim 1, wherein one of said first and second members is a conduit, and wherein the other one of said first and second members is a conduit.

5. The universal ground adapter assembly of claim 1, wherein one of said first and second members is a conduit, and wherein the other one of said first and second members is a kickpipe/stuffing tube assembly.

6. The universal ground adapter assembly of any one of claims 2, 3, 4, or 5, wherein said male and said female connectors are pipe-threaded.

7. The universal ground adapter assembly of claim 6, wherein one of said connection annuli is an adapter nut and the other of said connection annuli is a nipple.

8. The universal ground adapter assembly of claim 1, wherein said electrically conductive member receiving annuli are outer nuts.

9. The universal ground adapter assembly of claim 6, wherein said connection means includes a pressure ring and an iris so cooperative that the pressure ring bears against the iris and in such a way as to hold it in electrical contact with corresponding ones of said first and second members.

10. The universal ground adapter assembly of claim 1, wherein said environmentally sealing means includes O-rings.

* * * * *